US005848873A

United States Patent [19]

Schofield

[11] Patent Number: 5,848,873

[45] Date of Patent: Dec. 15, 1998

[54] VACUUM PUMPS

[75] Inventor: Nigel Paul Schofield, Horsham, England

[73] Assignee: The BOC Group plc, Windlesham, England

[21] Appl. No.: 848,368

[22] Filed: Apr. 30, 1997

[30] Foreign Application Priority Data

May 3, 1996 [GB] United Kingdom ..... 9609281

[51] Int. Cl.[6] ..... F01D 1/36

[52] U.S. Cl. ..... 415/90

[58] Field of Search ..... 415/90

[56] References Cited

U.S. PATENT DOCUMENTS

| | | | |
|---|---|---|---|
| 4,090,815 | 5/1978 | Nakamura | 415/90 |
| 5,547,338 | 8/1996 | Conrad et al. | 415/90 |
| 5,662,456 | 9/1997 | Englander | 415/90 |
| 5,664,935 | 9/1997 | Nishiuchi et al. | 415/90 |
| 5,688,106 | 11/1997 | Cerruti et al. | 415/90 |

*Primary Examiner*—John T. Kwon
*Attorney, Agent, or Firm*—David M. Rosenblum; Salvatore P. Pace

[57] ABSTRACT

A vacuum pump of the regenerative type comprising a rotor and a stator body in which the rotor is adapted for rotation. The rotor has a series of blades positioned in an annular array on a side of the rotor. The stator has an annular channel within which the blades can rotate having a cross-sectional area greater than that of the individual blades except for a small part of the channel which has a reduced cross-section providing a close clearance for the blades. Further, the rotor has at least two series of blades positioned in concentric annular arrays on a side of the rotor and the stator has a corresponding number of channels within which the blades of the arrays can rotate. The channels are linked to form a continuous passageway through which gas being evacuated by the pump can pass.

9 Claims, 4 Drawing Sheets

VACUUM PUMPS

BACKGROUND OF THE INVENTION

This invention relates to vacuum pumps and, more particularly, to pumps employing a regenerative mode of operation and preferably combined regenerative and molecular drag modes of operation.

Vacuum pumps and/or compressors are known which operate on a regenerative mode and in which a rotor spins at high speed, for example ten thousand revolutions/min (10,000 rpm), within a stator body. The rotor has a series of blades positioned in an annular array either on a peripheral edge of the rotor or alternatively on a side of the rotor at its periphery. The stator has an annular channel within which the blades rotate having a cross sectional area greater than that of the individual blades except for a small part of the channel known as a "stripper" which has a reduced cross section providing a close clearance for the blades. In use of the pump, gas to be pumped enters the annular channel via an inlet positioned adjacent one end of the stripper and the gas is urged by means of the blades on the rotating rotor along the channel until it strikes the other end of the stripper and the gas is then urged through an outlet situated on that other end of the stripper. It is known that pumps/compressors employing such a mode of operation can provide a high compression ratio at relatively low flow rates. However, with such pumps it can be difficult to obtain a sufficiently high ultimate vacuum without resort to the use of an additional vacuum pump in tandem; in addition a higher compression rate would be an advantage, together with the possibility of a smaller, and therefore light pump.

SUMMARY OF THE INVENTION

The present invention is concerned with the provision of a vacuum pump in which a substantially higher compression is obtained through the use of a multi-stage pumping action associated with the rotor in particular.

In accordance with the invention, there is provided a vacuum pump of the regenerative type comprising a rotor and a stator body in which the rotor is adapted for rotation. The rotor has a series of blades positioned in an annular array on a side of the rotor. Further, the stator has an annular channel within which the blades can rotate having a cross-sectional area greater than that of the individual blades except for a small part of the channel which has a reduced cross-section providing a close clearance for the blades. The rotor has at least two series of blades positioned in concentric annular arrays on a side of the rotor and the stator has a corresponding number of channels within which the blades of the arrays can rotate and means are provided to link the channels to form a continuous passageway through which gas being evacuated by the pump can pass.

Generally the rotor is shaped such that the side on which the arrays of blades are positioned presents a substantially flat surface for receiving the arrays; usually, the flat surface will be radially orientated relative to the main axis of the rotor. Generally, the flat surface between the arrays will cooperate with corresponding annular flat surfaces on the stator to provide a face seal between the arrays.

If appropriate, the invention also incorporates the possibility of there being at least two arrays of blades on each side of the rotor, each side preferably presenting a substantially flat surface for receiving the arrays.

In preferred embodiments, the rotor has at least five or six arrays on one or both sides thereof.

The individual blades of each array will generally be arranged radially in relation to the rotor. Each blade may be substantially flat or, at least in part, may be arcuate with the concave side pointing in the direction of travel of the rotor; the latter is preferred to assist in pumping efficiency.

It is preferred for the blade edges which co-operate with the stripper to have a flat surface rather than pointed or radiused ends to improve the "sealing" between the blades and the stripper.

Typically, each array may comprise at least about ten, preferably at least fifty blades. Generally, there may usefully be up to about one hundred and fifty blades in each array. Preferably the cross-sectional area of the main part of the channel is from three to six times that of the radial cross-section of the blade.

Having more than one series of blades in annular arrays on the surface of a rotor in accordance with the invention affords various advantages and opportunities.

Firstly the arrangement of the blades and corresponding channels in a series of concentric arrays relative to the pump shaft can provide an inherent volumetric compression ratio if a flow of gas being evacuated is caused to occur from the outermost array to the innermost array to exhaust towards the centre of the pump. This effect is increased if the cross-sectional area of the individual channels is decreased gradually from the outermost to the innermost channel. For example, in a pump having six such arrays, the cross-sectional area of the innermost channel may be of the order of one-sixth to one-half of that of the outermost channel.

Secondly, the concentric arrays of blades/channels allows for a shorter pump overall in the axial direction than one with a multi-stage axial array of blades.

Thirdly, the axial load can be reduced, in particular if the flow of gas is arrayed from the outside to the inside channel, because of the highest pressure forces in such an arrangement are at the centre of the pump and act over a smaller area.

Fourthly, use of a particularly preferred feature in which each array of blades is mounted on a raised ring present on the surface of the rotor with the corresponding stator channels being present about the blades to allow rotation of the blades therethrough but with a relatively close tolerance between the stator and the curved surfaces of the raised ring provides the opportunity of radial sealing between the rotor and the stator.

Pumps of the invention may be employed:

i) as individual vacuum pumps in their own right, ii) in conjunction with other vacuum pumps such as turbo molecular pumps or molecular drag pumps, iii) as a component part of larger hybrid vacuum pumps also comprising stages of different type, for example molecular drag stages.

It has been found, however, that hybrid pumps comprising a regenerative stage according to the invention together with a type of molecular drag stage, for example are known as a "Holweck" stage, is particularly beneficial. In a Holweck stage, there is provided alternate stationary and spinning concentric hollow cylinders with a threaded upstanding flange to form a helical structure substantially extending across the gap between adjacent cylinders, the flange being attached either to a surface of a spinning or of a stationary cylinder.

In such an embodiment in the invention, it has been found to be particularly useful to arrange the Holweck cylinders axially with the spinning cylinder(s) being mounted on the same shaft as the spinning rotor of the regenerative stage.

In conjunction with the regenerative pump stage of the invention in which the rotor blades will generally depend axially from the rotor, a corresponding axial arrangement of the Holweck cylinders is preferred. In combination with the regenerative blades on the rotor, this forms a pump that has no radially interleaving stator sections, thereby allowing ready assembly and disassembly of the pump.

In such respects, it is preferred for one pump stage to be on one side of the rotor and the other stage to be on the opposite side of the rotor. This feature affords the possibility of a smaller, lighter pump overall.

The Holweck stage will in particular generally be at the inlet (low vacuum) end of the pump and such an axial arrangement of the Holweck cylinders has been found to provide a natural inlet for the pump as a whole by causing gas to enter through the innermost cylinder.

In this preferred hybrid pump embodiment also, it can advantageously be arranged for gas flow in the Holweck stages to be from the centre outwards and in the regenerative stages to be from the outer periphery inwards, thereby leading to a balanced, efficient pump overall.

The feature described herein relating to improvements to Holweck stages may be useful for Holweck stages generally on their own or in conjunction with different types of stage to that described herein.

In combined regenerative/Holweck pumps of preferred embodiments of the invention, the general design lends itself advantageously to a single piece rotor which can usefully be made of a light metal or alloy, for example aluminium.

Pumps of the invention are particularly suitable for the handling of dust-laden gases, especially when adapted by certain preferred features described in conjunction with the specific embodiment of the invention described below.

BRIEF DESCRIPTION OF THE DRAWINGS

For a better understanding of the invention, reference will now be made, by way of exemplification only, to the accompanying drawings, in which.

DETAILED DESCRIPTION

Figure 1:
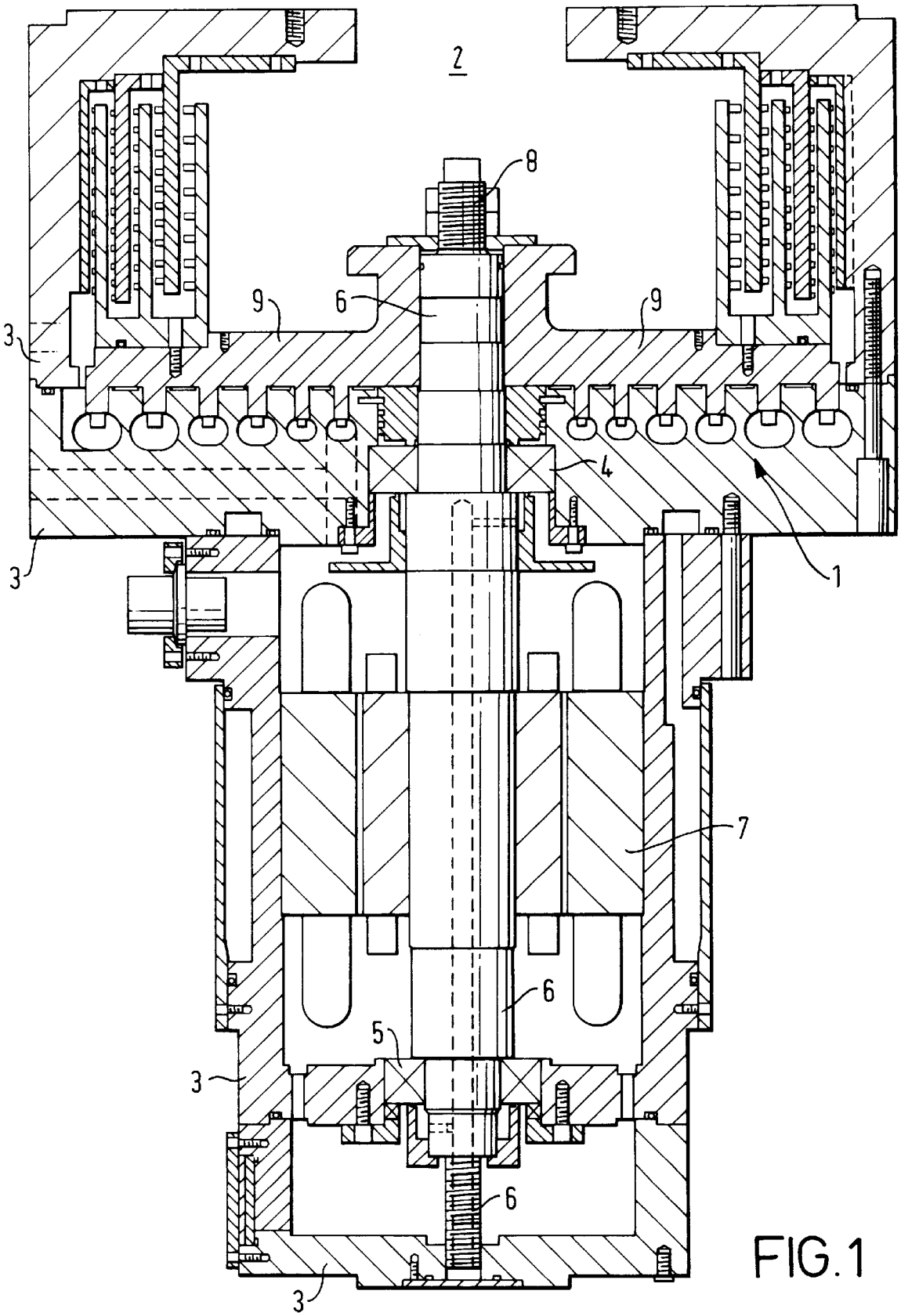
FIG. 1 is a sectional view through a representation of a vacuum pump of the invention having both regenerative and Holweck stages.

With reference to the drawings and initially to FIG. 1 in particular, there is shown a compound vacuum pump having a regenerative stage generally indicated by reference numeral 1 and a molecular drag (Holweck) stage generally indicated by the reference numeral 2.

The vacuum pump comprises a housing 3 made of a number of different body portions bolted (or otherwise fixed) together and provided with relevant seals therebetween.

Mounted within the housing 3 between bearings 4, 5 is a shaft 6. The shaft 6 is adapted for rotation about its longitudinal axis and is driven by an electrical motor 7 surrounding the shaft 6 in a manner known per se.

Figure 2:
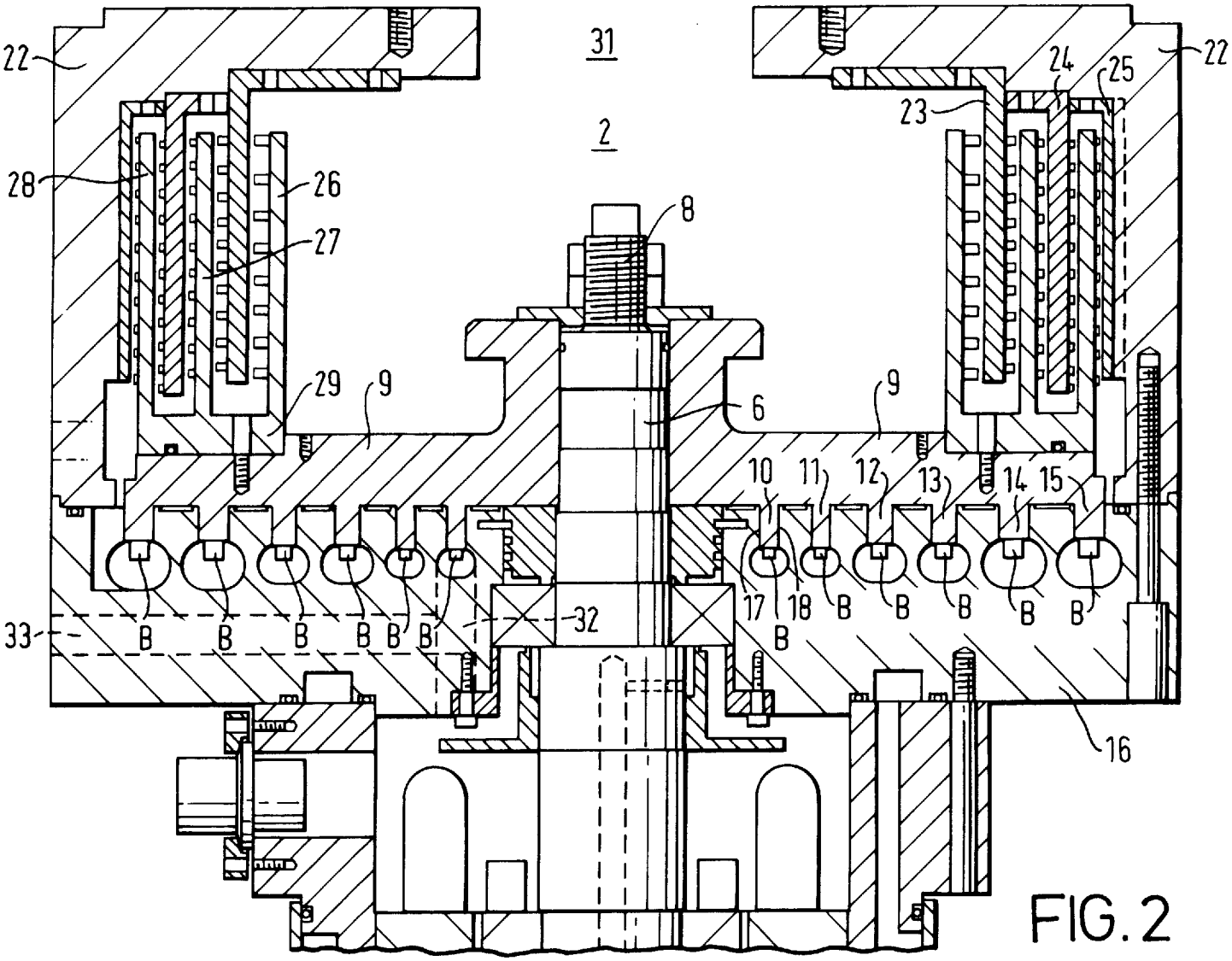
FIG. 2 is an enlarged sectional view of the representation shown in FIG. 1 with particular emphasis on the vacuum stages.

With regard to the regenerative stage 1, securely attached to the shaft by bolt means 8 is a rotor 9. Turning in addition to FIG. 2, the rotor 9 is generally in the form of a circular disc, the lower (as shown) surface of which presents a substantially flat surface on which are positioned integrally therewith a plurality (six) of raised rings 10, 11, 12, 13, 14, 15 situated symmetrically on the rotor about its centre point. Mounted on each of the raised rings is a series of equally spaced blades B, for example, one hundred blades on each ring to form concentric annular arrays of blades.

The width of each ring, and the corresponding size of the blades on each ring, gradually decreases from the outermost ring 15 to the innermost ring 10.

Figure 5:
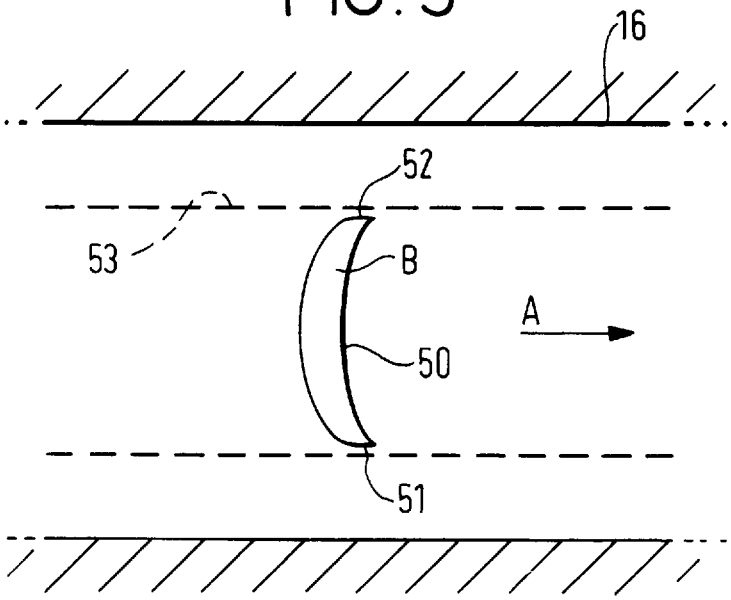
FIG. 5 is a sectional view of an individual regenerative stage blade taken along the line V—V of FIG. 3.

Each of the blades is slightly arcuate with the concave side pointing in the direction of travel of the rotor as shown more clearly in FIG. 5.

The body portion 16 of the housing 3 forms the stator and contains six circular channels in its upper (as shown) surface which are of "keyhole" cross section and are of a size which closely accommodates in the rectangular section upper (as shown) parts the six raised rings 10, 11, 12, 13, 14, 15; the circular section lower (as shown) parts accommodate the corresponding blades of the relevant raised ring, the blade cross section being about one sixth of the cross sectional area of the circular section part of the channels.

As with all pumps of the regenerative mode of operation of this general type, each channel (in this case the circular cross-section part thereof) has a reduced cross sectional area (not shown) for a small, for example 1 cm, part of its length of a shaped size substantially the same as that of the corresponding blades accommodated therein. This reduced cross sectional part of each channel forms the "stripper" which, in use, urges gas passing through that channel to be deflected by porting (not shown) in to the next (inner) channel.

The arrangement described above including the mounting of the blade on the raised rings has an improvement in that it allows for radial sealing between the rotor and stator as well as axial sealing previously employed. In this respect, the radial sealing occurs between the sides of the raised rings 10, 11, 12, 13, 14, 15 and the corresponding sides of the rectangular cross sectional part of the relevant channel, ie at 17, 18, especially the outermost sides 18 as shown in respect of the ring 10 only to aid clarity in the drawings.

Figure 3:
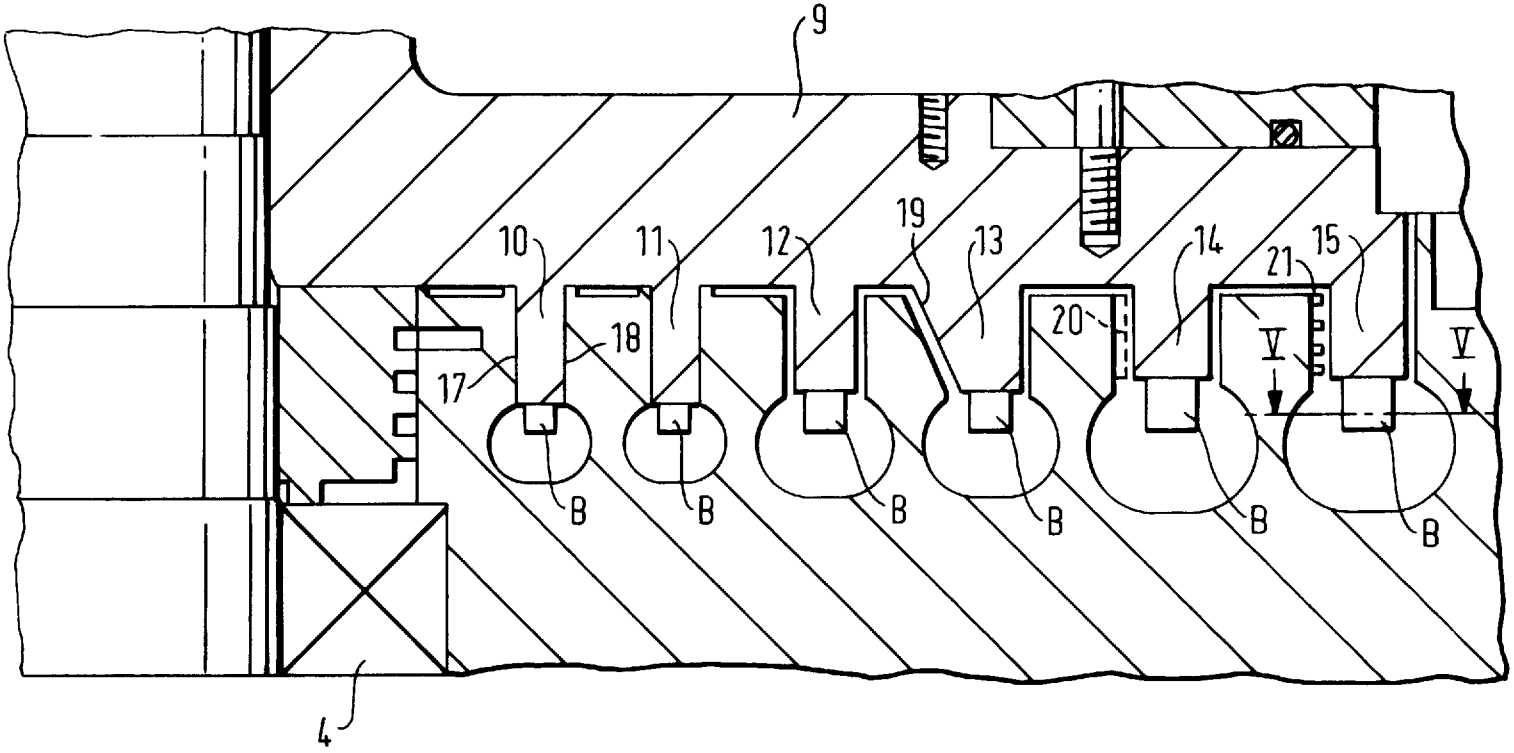
FIG. 3 is a further enlarged sectional view of the representation shown in FIGS. 1 and 2 with particular emphasis on the regenerative stage and on various optional features which may be used therein.

The pump of the invention is especially suitable for use in conditions necessitating the handling of dust-laden gases. FIG. 3 is an enlarged view of the right hand side only of this part of the regenerative stage showing various optional features which can be employed in one or more of the regenerative channels.

The channels associated with the raised rings 10, 11, 12 as shown in FIG. 3 are as described above. However, the raised ring 13 and the corresponding channel are shown of modified cross sectional shape such that any dust which might accumulate in this area through the action of centrifugal forces in particular will not tend to do so as it would be urged down the slope at 19 again by the action of centrifugal forces.

The channel associated with the raised ring 14 is shown in FIG. 3 to have on the inner surface of the rectangular section part a thin, straight projection 20 (or a number of such projections spaced apart) directed in a substantially axial direction with a blade surface directed towards the raised ring 14 such that any dust tending to accumulate in this area would be scraped away and urged towards the circular cross section part of this channel.

The channel associated with the ring 15 is shown in FIG. 3 to have on the inner surface of the rectangular section part a helical projection 21 (extending right round the ring) which again would act such that any dust tending to accumulate in this area would be scraped away and urged down the helix towards the circular cross section part of this channel.

Normally, only one such dust handling feature would be used in any one pump on one or more of the rings. However, it would be possible to adopt two or more of the features in a single pump or to combine the "sloped" feature described above with reference to the ring 13 with the features described above with reference to the ring 14 or the ring 15.

Returning to FIG. 2 in particular and with regard to the Holweck stage 2; this stage is generally formed within a body portion 22 of the housing.

Depending from the body portion 22 and forming the stator for this stage are a set of three hollow annular cylinders 23, 24, 25 orientated axially with regard to the shaft 6.

A set of three further concentric hollow cylinders 26, 27, 28, also orientated axially with regard to the shaft 6, are securely fixed at their lower (as shown) ends to be upper surface of the rotor 9. In this embodiment described, these three cylinders are integrally formed and joined by a base plate 29 for ready assembly/dis-assembly in the pump.

Each of the six cylinders is mounted symmetrically about the main axis of the pump and the cylinders of one set are inter-leaved with those of the other set in the manner shown in FIG. 2, thereby forming a uniform gap between each adjacent cylinder. This gap, however, reduces from the innermost adjacent cylinders to the outermost adjacent cylinders.

Situated in the gap between each adjacent cylinder is a threaded upstanding flange (or flanges) to form a helical structure substantially extending across the gap. This flange can be attached to either of the adjacent cylinders. In accordance with preferred embodiments, however, and especially for use in dealing with dust-laden gases, the flange is attached to the outer facing surface of each cylinder so that, in particular, any dust which tends to collect on the inner facing surfaces through the action of centrifugal force will not be trapped in the helical structure, especially that of a stationary cylinder.

FIG. 2 shows such a preferred embodiment; it should be noted that the upstanding flanges are not shown in FIG. 1.

Although not shown in the drawings, it should be noted that the rotor 9 and the base plate 29 together with the hollow cylinders 26, 27, 28 could all usefully be manufactured as a one-piece component made, for example from aluminium or an aluminium alloy.

Figure 4:
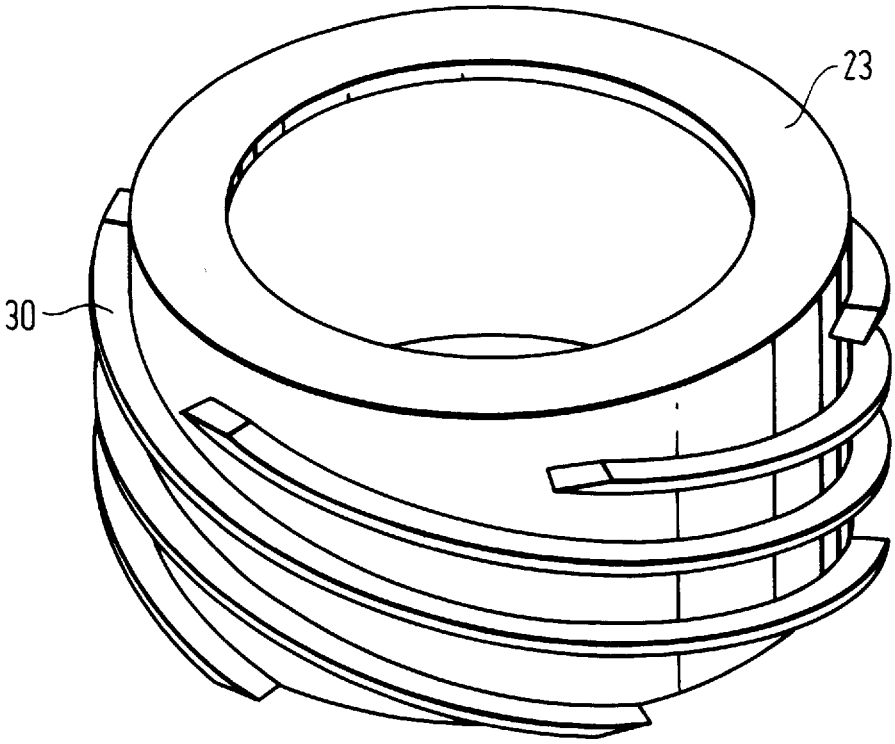
FIG. 4 is a perspective view of part of a cylinder used in the Holweck stage of the pump shown in FIGS. 1 to 3.

FIG. 4 shows part of the cylinder 23 with an upstanding flange 30 attached in the form of a number of individual flanges to form a helical structure overall. The other cylinders 24 and 25 would have substantially the same construction.

In use of the pump with the shaft 6 and rotor 9 spinning at high speed, gas is drawn in to an inlet 31 within the body portion 22 and in to the gap between adjacent cylinders 23, 26. It then passes down the helix formed by the upstanding flange in the cylinder 26 and thence up the gap between the cylinders 23, 27 and so on until it passes down the gap between the cylinder 25, 28. It then passes through porting not shown in to the circular section part of the channel associated with the ring 15, thence through the channels associated with the rings 14, 13, 12, 11, 10 (in that order) by means of the action of the respective strippers until being exhausted from the pump via the bores 32, 33 in the body portion 16.

The gas flow is therefore generally radially outwards in the molecular drag (Holweck) stage and radially inwards in the regenerative stage, thereby leading to a balanced, efficient pump. This can generally obviate the need to provide a plurality of dynamic seals between high pressure regions and low pressure regions of the pump.

The arrangement described with reference to the drawings can also be readily assembled/dis-assembled by virtue of an ability to remove the shaft and rotor axially for maintenance simply by removal of the body portion 22.

Finally, FIG. 5 shows a sectional view of an individual blade B showing its concave surface 50 and the flat surfaces 51, 52 at each side of the blades B. As stated above, this enables an improved sealing between blades and the stripper, the co-operating edges 53 of which are shown as dotted lines in FIG. 5. The direction of travel of the blades B on the rotor 9 is shown by the arrow A within the channels 54 in the body portion 16.

I claim:

1. A vacuum pump of the regenerative type comprising:

a stator body;

a rotor to rotate within said stator body;

the rotor having at least two series of blades positioned in concentric annular arrays on a side of the rotor;

the stator body having at least two annular channels within which the blades rotate, each of said at least two annular channels having a cross-sectional area greater than that of the said blades; and means for linking the at least two annular channels to form a continuous passageway for passage of gas being evacuated by the pump.

2. The pump according to claim 1 in which said concentric annular arrays are positioned in each side of the rotor.

3. The pump according to claim 1 in which the gas being evacuated flows from outermost to innermost of the concentric annular arrays and centrally exhausts.

4. The pump according to claim 1 in which the cross-sectional area of each of said at least two channels is decreases from outermost to innermost of said channels.

5. The pump according to claim 1 in which each of said at least two series of blades is mounted on a raised ring present on the surface of the rotor with corresponding of said at least two stator channels being present about the blades to allow rotation of the blades therethrough and radial sealing between the rotor and the stator body.

6. The pump according to claim 1 in which said pump is hybrid pump comprising a regenerative stage together with a molecular drag stage.

7. The pump according to claim 6 in which the molecular drag stage is a Holweck stage comprising alternate stationary and spinning cylinders.

8. The pump according to claim 7 in which the Holweck cylinders are arranged axially with the spinning cylinders being mounted on the same shaft as the spinning rotor of the regeneration stage.

9. The pump according to claim 7 in which the Holweck cylinders are arranged axially.

* * * * *